US005121990A

United States Patent [19]

Guiet et al.

[11] Patent Number: 5,121,990

[45] Date of Patent: Jun. 16, 1992

[54] DEVICE FOR THE PREPARATION OF A PASTE

[76] Inventors: Jacques Guiet, La Vannoire, 85310 Nesmy; Philippe Martin, BP 185 Inham de, 85100 Les Sables D'ol, both of France

[21] Appl. No.: 943,316

[22] Filed: Dec. 19, 1986

[30] Foreign Application Priority Data

Dec. 23, 1985 [FR] France ..... 85 19025

[51] Int. Cl.[5] ..... B01F 13/06

[52] U.S. Cl. ..... 366/139; 366/110; 366/112; 366/602; 366/347

[58] Field of Search ..... 366/110, 111, 112, 114, 366/139, 602, 108, 209, 212, 240–252, 219, 117, 118, 347; 606/92.84, 87; 433/213, 233; 422/225, 99, 104; 264/69, 71, 72, 102; 425/456, 432, 424, 546, DIG. 6

[56] References Cited

U.S. PATENT DOCUMENTS

| | | | |
|---|---|---|---|
| 1,772,083 | 8/1930 | Hollenback | 366/302 |
| 1,863,977 | 6/1932 | Forde et al. | 366/111 |
| 2,301,947 | 11/1942 | Hannen | 366/108 |
| 2,453,914 | 11/1948 | Hollenback | 366/139 |
| 2,973,187 | 2/1961 | Wehmer | 366/139 |
| 3,131,912 | 5/1964 | Steinbock, Jr. . | |
| 3,139,270 | 6/1964 | Steinbock, Jr. | 366/114 |
| 3,411,755 | 11/1968 | Strauss et al. | 366/602 |
| 3,559,961 | 2/1971 | Bergendal | 366/602 |
| 3,620,508 | 11/1971 | Lea | 366/108 |
| 3,640,510 | 2/1972 | Lea . | |
| 4,071,225 | 1/1978 | Hall | 366/114 |
| 4,473,673 | 9/1984 | Williams et al. | 264/102 |

FOREIGN PATENT DOCUMENTS

| | | |
|---|---|---|
| 2425158 | 12/1975 | Fed. Rep. of Germany . |
| 1473563 | 2/1967 | France . |
| 2307572 | 11/1976 | France . |
| 903592 | 8/1962 | United Kingdom . |

*Primary Examiner*—Harvey C. Hornsby
*Assistant Examiner*—Joseph S. Machuga
*Attorney, Agent, or Firm*—Young & Thompson

[57] ABSTRACT

The present invention relates to a preparation method of a paste by mixing at least one constituent substance in a solid form, notably a powder, with at least one constituent substance in a liquid form, mechanically kneading the mixture under vacuum and subjecting said mixture to vibrations under vacuum.

According to the invention, the mixture is subjected to a vibration field during at least the final phase of the mechanical kneading in a device comprising a base (2), a bowl of revolution (28) carried by said base, a cover (21) closing said bowl in a tight manner, an evacuation duct (10) opening into the bowl and kneading blades (27), the bowl being suspended underneath the cover and removably connected to said cover with means (11*a*, 11*b*) for imparting vibrations to the cover and bowl assembly via the cover.

The present invention applies to the preparation of alginate, plaster or similar substances based pastes.

3 Claims, 2 Drawing Sheets

DEVICE FOR THE PREPARATION OF A PASTE

FIELD OF THE INVENTION

The present invention relates to the preparation of an alginate, plaster or similar substances based molding paste, said preperation being carried out by stirring an alginate, plaster or similar substance powder with water and the pastes obtained being used in dentistry and notably, as regards the alginates, for the molding of dental imprints and, as regards the other substances mainly mixtures of plaster with silica, silicate or phosphate for the molding of backings for lost wax processes. Said pastes have to be absolutely homogeneous and should not have any included gas pockets.

BACKGROUND OF THE INVENTION

It is usual to provide said mixtures by a mechanical kneading operation, notably with a blade agitator of mixer driven in rotation in the bowl containing the mixture. It has also been proposed, for eliminating from the mixture the gaseous inclusions, to evacuate the bowl during the kneading operation.

FR-A-1 473 563 which relates to the same technical field proceeds, in a first chamber, to a kneading operation under vacuum, then for improving the elimination of the gas pockets and the homogenizing, transfers the mixture to a second chamber in which the paste is simultaneously subjected to mechanical vibrations and to vacuum. It is in fact known, notably in the technique of concretes, that vibrations improve the homogeneity of pastes.

Said known method of preparing a paste under vacuum, which carries out the kneading operation in a first enclosure and the vibrations in a second enclosure has many practical disadvantages such as notably the necessity of a transfer from one enclosure to the other during the preparation process. It also has other disadvantages with regards to the homogeneity of the mixture and the presence in the final mixture of very small gaseous pockets.

The first of said disadvantages is due to the fact that the mixer or kneader has dead areas, notably the surface layer adhering to the bowl wall and to the blades of the kneading device, areas where no mechanical kneading of the paste is taking place. The second of said disadvantages results from the small amplitude of the mechanical vibrations, which is insufficient for providing a circulation of the fine gaseous bubbles causing a coalescence which increases their volume in such manner that a sufficient lift is imparted to them, notably in a viscous paste.

OBJECTS AND SUMMARY OF THE INVENTION

The present invention results from the discovery that it is possible to avoid all these disadvantages.

The method according to the invention for preparing a paste by mixing at least one constituent substance in the form of a powder with at least a constituent substance in the form of a liquid, mechanically mixing under vacuum the mixture and subjecting the mixture to vibrations under vacuum, is characterized in that the mixture is subjected to a vibration field during at least the final phase of the mechanical kneading.

According to a preferred embodiment, the mixture is first subjected to vibrations, then, after having been set under vacuum, mechanically kneaded. This vibrating operation prior to mixing enhances the wetting of the powder by the liquid prior to the kneading operation. The vibration frequency should be between 50 and 15000 Hz, preferably between 2000 and 8000 Hz and the amplitude between 0.1 and 5 mm.

In the method according to the invention, the subjection to vibrations of the mixed mass during the kneading operation loosens the superficial layers from the walls and rejects them in the region subjected to the flow and lamination of the paste streams due to the mechanical stirring. Simultaneously, the fine gaseous bubbles are subjected, due to the vibrations, to rapid cycles of compression-depression assisting their circulation in the paste, but they are at the same time set in circulation by the mechanical stirring, which enhances the coalescence in the form of bubbles of larger volume having a higher lift and ascensional velocity.

The present invention has also for object a device for practicing the method, said device including a base, a rotatable bowl carried by said base, a cover which closes the bowl in a tight manner, an evacuation duct opening underneath the lower face of the cover and connected at its other end to a vacuum source and kneading blades carried by an axle extending through the cover, said axle being connected via a connecting member to a motor for driving it in rotation and the device being characterized in that the bowl is suspended underneath the cover and removably fixed to said cover together with means for imparting vibrations to the cover and bowl assembly via the cover.

According to another feature, the bowl wall includes a circuit for a refrigerating agent.

Other features of the invention, and notably of the device, will become more apparent from the reading of the hereafter detailed description, with reference to the accompanying drawings in which FIG. 1 is a schematic elevation view, partly in section, of a device for practicing the kneading method; and FIG. 2 is an enlarged fragment of FIG. 1.

DETAILED DESCRIPTION OF THE INVENTION

Figure 1:
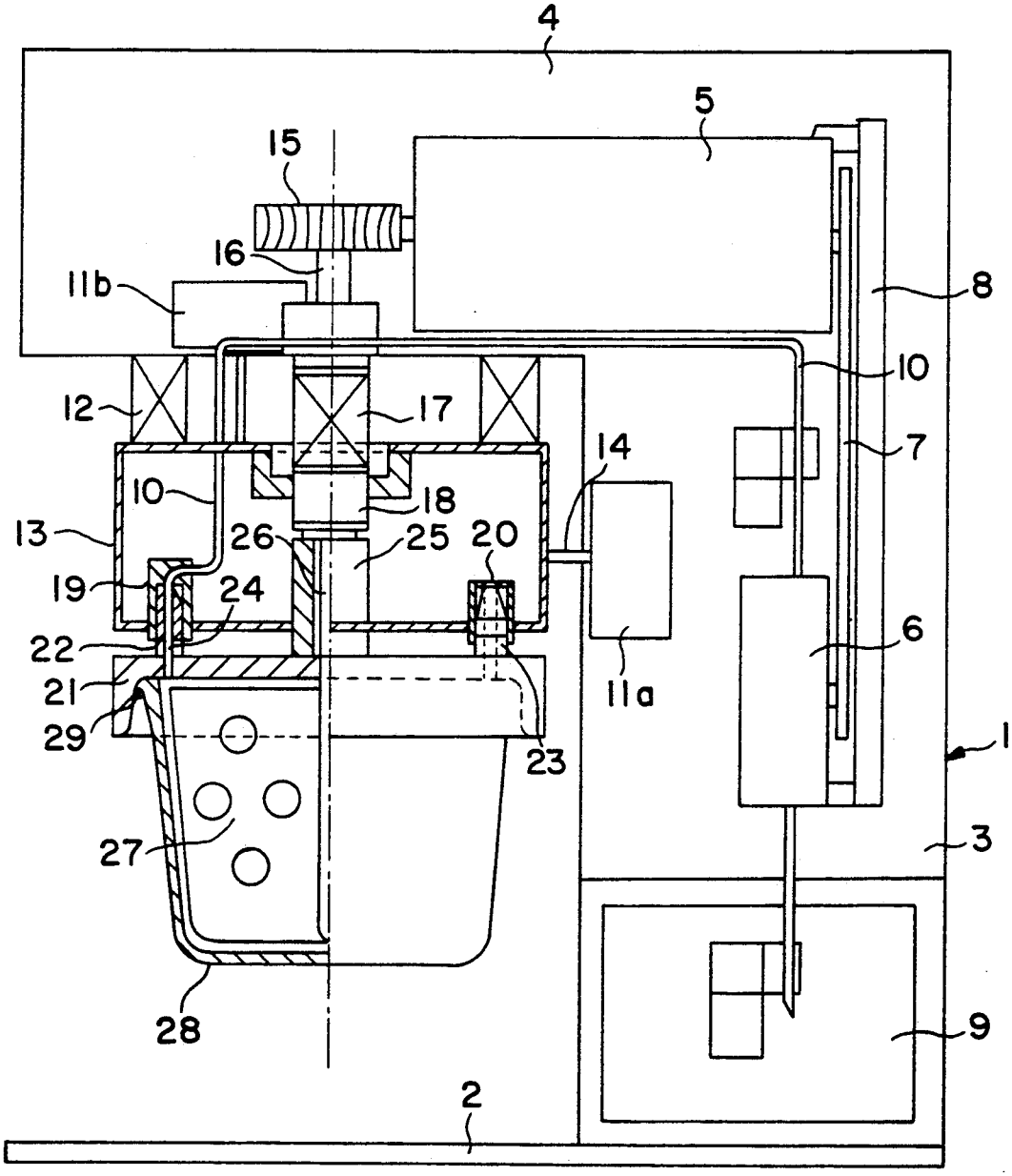
Figure 2:
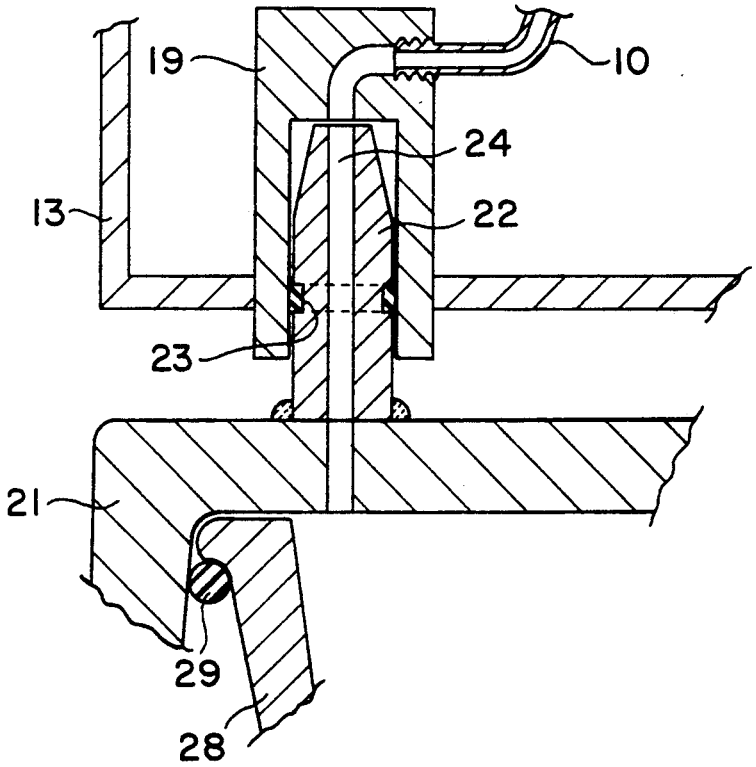

The device includes a frame designated generally by reference 1 with a stand 2, a foot forming a column 3 and an upper bracket 4. In the portion of the frame forming column 3 and bracket 4 are housed the electric motor 5 for driving the assembly and the vacuum pump 6 driven by the motor via a transmission belt 7, the motor and the pump being mounted on a platen 8. The vacuum pump 6 delivers in a filtration and damping chamber 9 and sucks in via a duct 10. On the frame are also mounted a vertical vibration generator **11*a* and a horizontal vibration generator 11*b***.

Underneath bracket 4 is suspended, via resilient blocks 12, the vibrating base 13 which is a caisson connected by a stem **14*a* to the vibrating member of generator 11*a* and by stem 14*b* to vibration generator 11*b***.

The shaft of motor 5 drives via a reducing gear 15 a vertical shaft 16 which is rigidly connected via a deformable resilient coupling 17 to an axle connecting block of any known type 18, said connecting block being rigidly connected to the vibrating base 13.

Vibrating base 13 is formed in its bottom with three cylindrical recesses spaced apart by 120°, one of said recesses 19 being connected to a channel 10 of the vacuum pump and the two others 20 being blind.

Cover 21 of the kneading bowl carries three nipples 22 for engaging in a tight manner and via a peripheral seal 23 the three recesses, said nipples having a central channel 24 opening into the lower face of cover 21. In its centre, cover 21 includes a sleeve 25 inside which is rotatably and tightly mounted an axle 26 carrying perforated blades 27 at its lower portion. When the cover is in position on the vibrating base 13 by engagement of nipples 22 in recesses 20–21, sleeve 25 and shaft 26 are engaged in a window of the lower surface of the base, and shaft 26 snaps into the axle connection block 18 so that blades 27 can be driven in rotation by motor 5.

Bowl 28 is then sealed closed by a seal 29 underneath cover 21.

The operation of the device is the following:

After having poured the mixture constituents into bowl 28, cover 21 being put in position on bowl 28, the assembly 21–28 is applied against vibrating base 13. The vibrations direction is selected by switching the vibration generator power supply to generator 11*a* providing vertical vibrations or 11*b* providing horizontal vibrations, said vibrations having a frequency of 5 to 6000 Hz and an amplitude between 1.25 and 2.50 mm. Once the vibration generator is operating, motor 5 is started and it drives vacuum pump 6 which sets the volume of the bowl under vacuum via channel 10 and channel 24 of nipple 22 engaged in recess 19. The suction is also transmitted via channel 24 to the two other nipples inside recesses 20, thereby providing a reeinforced application of the cover 21 and bowl 28 assembly underneath vibrating base 13. The result is that the mixing and kneading operations are carried out under vacuum under the combined action of a mechanical agitation and vibrations.

By way of an example for practicing the method, a mixture made of 25 g of alginate and 20 g of water at a temperature of 9° C. have been placed in the bowl. The vacuum in the bowl was of 110 KPa, the blade rotation speed was 250 rpm and the vibration frequency was 5500 Hz with an amplitude of 1.75 mm. After 20 seconds of operation, the alginate mixture was perfectly homogeneous, without any noticeable gas pockets.

What is claimed is:

1. A device for the preparation of a paste, comprising a base, a bowl, a cover sealingly closing the bowl, a vacuum duct opening at one end beneath the underside of the cover, a source of vacuum connected to the vacuum duct at the other end of the vacuum duct, an axle extending through the cover, kneading blades carried by the axle within the bowl, a motor for driving the axle in rotation thereby to rotate the blades in the bowl, means supporting the cover from the base, and means for imparting vibrations to the cover and via the cover to the bowl, the frequency of said vibrations being between 50 and 15,000 Hz and the amplitude of said vibrations being between 0.1 and 5 mm, the cover having a plurality of upstanding nipples that engage in recesses in the base, said nipples having openings therethrough that communicate between the interior of the bowl and said recesses, whereby vacuum drawn within the bowl releasably secures the cover to the base.

2. A device according to claim 1, said vacuum duct communicating with one of said nipples.

3. A device according to claim 1, there being three said nipples equally spaced about the periphery of the cover.

* * * * *